US005857499A

United States Patent [19]

Rohde et al.

[11] Patent Number: 5,857,499

[45] Date of Patent: Jan. 12, 1999

[54] DEVICE FOR MANIPULATING A WOUND COIL

[75] Inventors: Terry L. Rohde, Delray Beach, Fla.; Robert Misley, Buford, Ga.; Noel Eberhardt, Cupertino, Calif.; Edward Myszka, St. Charles, Ill.

[73] Assignee: Motorola, Inc., Schaumburg, Ill.

[21] Appl. No.: 569,887

[22] Filed: Dec. 8, 1995

[51] Int. Cl.[6] ..... B21F 03/00

[52] U.S. Cl. ..... 140/71 R; 140/102

[58] Field of Search ..... 140/1, 71 R, 92.1, 140/92.2, 93 R, 102, 113; 29/749, 753, 33 F

[56] References Cited

U.S. PATENT DOCUMENTS 2,861,601 11/1958 Marzolf ..... 140/92.1

4,638,558 1/1987 Eaton ..... 140/102

*Primary Examiner*—Lowell A. Larson

*Attorney, Agent, or Firm*—Douglas D. Fekete; John MacIntyre

[57] ABSTRACT

A device (10) for manipulating a wound coil (18) includes a mechanism for grabbing a wound coil (18), a first pair of opposed fingers (12), and a second pair of opposed fingers (14). The first pair of opposed fingers (12) oppositely engage a start lead (20) of the wound coil (18) and move along an arc from a first position where the start lead (20) is tangential to the inner circumference of the wound coil (18) to a second position where the start lead (20) is chordal to the inner circumference of the wound coil (18). The second pair of opposed fingers (14) oppositely engage a finish lead (22) of the wound coil (18) and move along an arc from a first position where the finish lead (22) is tangential to the outer circumference of the wound coil (18) to a second position where the finish lead (22) is chordal to the outer circumference of the wound coil (18).

10 Claims, 2 Drawing Sheets

DEVICE FOR MANIPULATING A WOUND COIL

FIELD OF THE INVENTION

This invention relates generally to a device for manipulating articles, and more particularly to a device for manipulating wound coils.

BACKGROUND OF THE INVENTION

Tightly wound coils are used in a variety of electronic applications. In typical coil winding devices, a thin copper wire is wrapped repeatedly around a spindle. Once the desired size of a wound coil is achieved, the coil end is cut. A device then removes the wound coil from the coil winder and carries the wound coil to a substrate. The two ends of the coil, also known as leads, are positioned onto contacts on the substrate. The leads are then manually soldered to the contacts. The manual process of positioning and soldering the leads to the substrate results in high manufacturing costs, long cycle times, and product quality that is difficult to control.

Consequently, a need exists for a device that is effective in manipulating a wound coil. More particularly, a need exists for a device that is capable of manipulating the leads of a wound coil and preparing them for later use, such as in attaching the leads to contacts on a substrate.

DETAILED DESCRIPTION OF A PREFERRED EMBODIMENT

Figure 2:
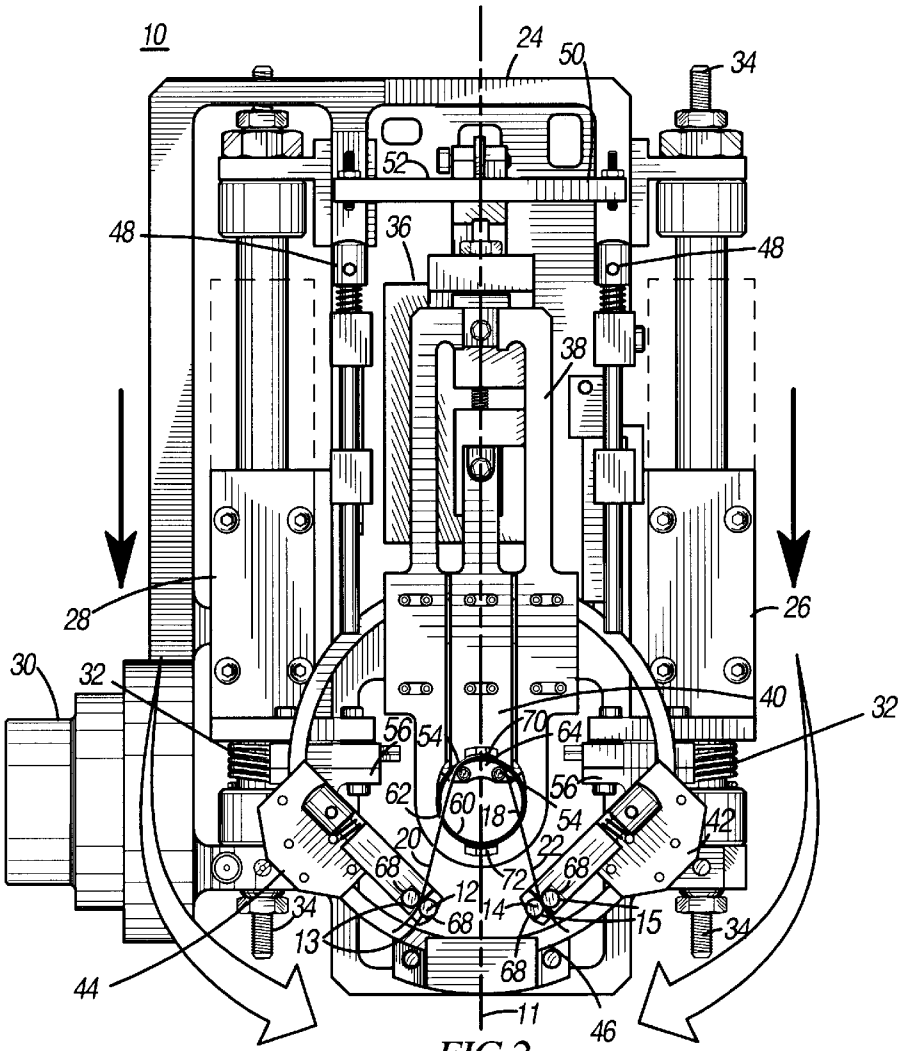
FIG. 2 is a front plan view of the device for manipulating a wound coil in FIG. 1 subsequent to engaging the wire leads.

A preferred embodiment of the present invention provides a device 10 for manipulating a wound coil 18. Wound coil 18 includes a start lead 20, a finish lead 22, a coil center, an inner circumference 60, and an outer circumference 62. Device 10 includes a mechanism for gripping a portion of wound coil 18 and a first pair 12 and a second pair 14 of opposed fingers. First pair of opposed fingers 12 oppositely engage start lead 20 and second pair of opposed fingers 14 oppositely engage finish lead 22. Device 10 further includes a mechanism for moving the pairs of fingers along an arc about an axis that is different from the coil center from a first position where the leads are tangential to inner circumference 60 and outer circumference 62 to a second position where the leads are chordal to inner circumference 60 and outer circumference 62. The movement of the leads without breakage prepares wound coil 18 for later processing. Wound coil 18 can be used as an antenna, and in a preferred embodiment is used as an antenna in a radio frequency tag application.

Figure 1:
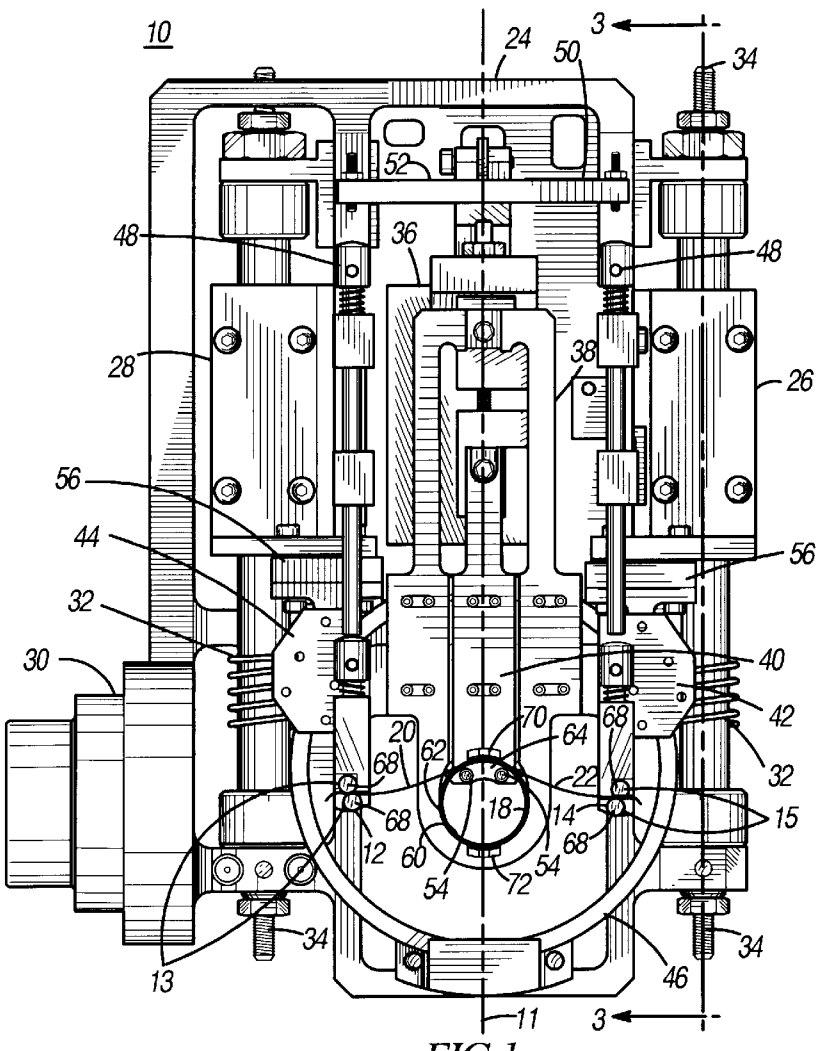
FIG. 1 is a front plan view of a device for manipulating a wound coil prior to engaging wire leads in accordance with a preferred embodiment of the present invention.
Figure 3:
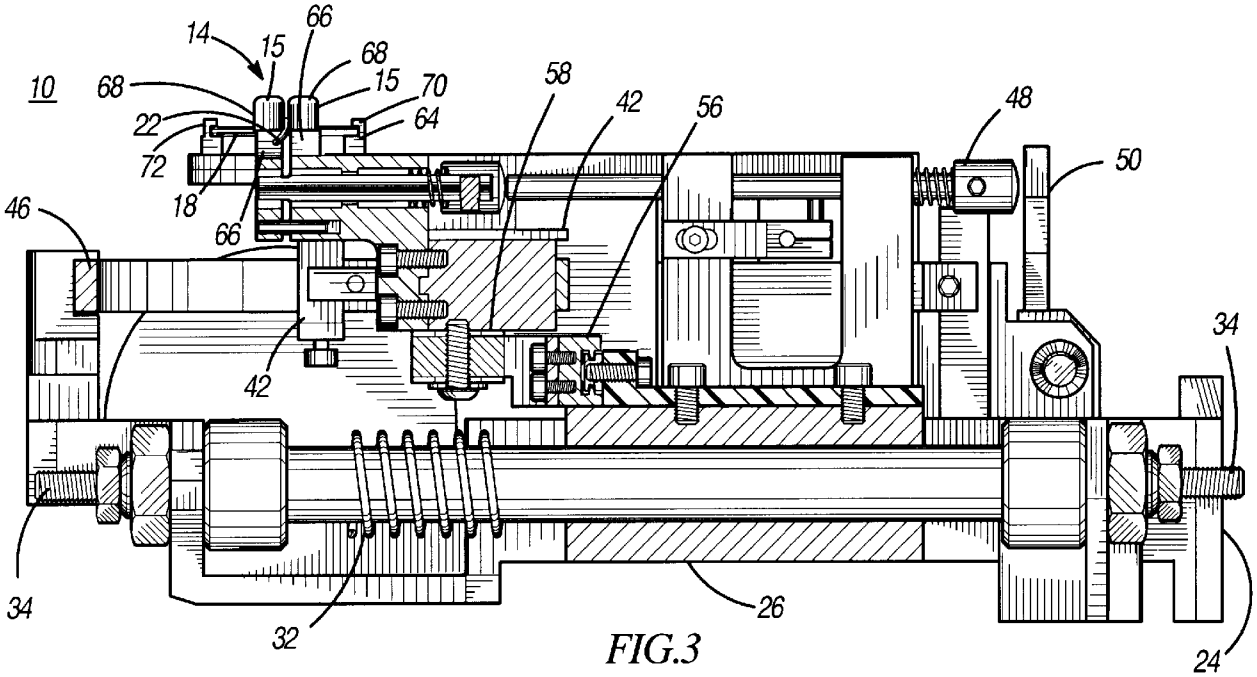
FIG. 3 is a side elevation view of the device for manipulating a wound coil in FIG. 1.

Referring to FIGS. 1–3, in accordance with a preferred embodiment of the present invention, a device 10 for manipulating a wound coil is shown. Device 10 comprises a frame 24, preferably composed of aluminum. An axis 11 is shown in dashed line to run substantially vertically through device 10. Left rodless air cylinder 28 and right rodless air cylinder 26 are mounted onto frame 24. Miniature cross slides 56 connect to knuckles 58, which couple air cylinder 26 and air cylinder 28 to finger bridge block 42 and finger bridge block 44. Bridge blocks 42 and 44 are attached to finger assemblies 12 and 14 and slide along wire finger track ring 46. Wire finger actuator lever 50 is coupled to air cylinder 52, which engages lever 50. Lever 50 moves axially to move wire finger actuator rods 48. Rods 48 engage finger assemblies 12 and 14, which in turn opens fingers 13 and 15.

Parallel jaw gripper 36 is mounted to frame 24. Inner extension arm 40 and outer extension arm 38 are mounted onto parallel jaw gripper 36. Deceleration springs 32 engage air cylinders 26 and 28 to slow air cylinders 26 and 28 during processing. Wire lead forming pins 54 are disposed on frame 24. Adjustable travel stops 34 are connected to the lower portion of air cylinders 26 and 28. Pivot wrist pilot 30 is connected to frame 24 and rotates device 10 90° when processing.

A wound coil 18 includes a start lead 20, a finish lead 22, a coil center, an inner circumference, and an outer circumference. Device 10 manipulates wound coil 18 and includes a mechanism 64 for gripping a portion of wound coil 18. Device 10 also includes a first pair of opposed fingers 12 that oppositely engage start lead 20 and a second pair of opposed fingers 14 that oppositely engage finish lead 22. Device 10 further includes a mechanism 44 that moves first pair of opposed fingers 12 along an arc about an axis that is different from the coil center from a first position where the start lead is tangential to inner circumference 60 of wound coil 18 to a second position where start lead 20 is in contact with forming pin 54 and is chordal to inner circumference 60 of wound coil 18. Start lead 20 remains under tension but does not break. A mechanism 42 moves second pair of opposed fingers 14 along an arc about the axis from a first position where finish lead 22 is tangential to outer circumference 62 of wound coil 18 to a second position where finish lead 22 is in contact with forming pin 54 and is chordal to outer circumference 62 of wound coil 18. Finish lead 22 remains under tension but does not break. In this manner, wound coil 18 is manipulated by device 10 and is prepared for varied purposes, such as attaching leads 20 and 22 to contacts on a substrate.

Device 10 includes an outwardly extending spindle flange 64 configured to receive at least a portion of wound coil 18. Spindle flange 64 is effective in grasping and holding wound coil 18 during processing.

Mechanism 64 also includes adjustable upper pair of spindle fingers 70 and lower pair of spindle fingers 72 spaced a predetermined distance away from each other and configured to receive at least an upper and lower portion of wound coil 18, respectively. In a preferred embodiment, spindle fingers 70 and 72 are L-shaped. Upper and lower spindle fingers 70 and 72 provide opposing forces on wound coil 18 to ensure that the coil shape is not deformed during processing.

Mechanism 64 also includes an open position that is adapted to receive a portion of wound coil 18 and a closed position that is adapted to receive a portion of wound coil 18 to grip a portion of wound coil 18. Mechanism 64 is moved to an open position when wound coil 18 is ready to be received. Once coil 18 is in place, mechanism 64 moves to a closed position to securely grip wound coil 18 during processing.

Mechanism 64 includes adjustable upper pair of spindle fingers 70 and lower pair of spindle fingers 72 and substantially retractable forming pins 54 adjacent and parallel to upper pair of spindle fingers 70, for facilitating placement of wound coil 18. Forming pins 54 retract when spindle fingers 70 and 72 are receiving wound coil 18 and spring back into position once coil 18 has been securely gripped. Forming pins 54 are located adjacent to upper spindle fingers 70 and are parallel thereto and facilitates the placement of wound coil 18 by retracting when wound coil 18 is presented.

Forming pins 54 are proximate to inner circumference 60 of wound coil 18. This allows forming pins 54 to reside near leads 20 and 22, which are extended from inner circumference 60 and outer circumference 62 of wound coil 18.

Device 10 includes a pair of forming pins 54 positioned in proximity to inner circumference 60 of wound coil 18. Forming pins 54 define predetermined pivot points. This is effective for forming pivot points about which leads 20 and 22 are pivoted and bent about when moving leads 20 and 22 from a first position to a second position. The pivot point is selected to facilitate keeping leads 20 and 22 under tension while fingers 13 and 15 allow leads 20 and 22 to slip through distal sections 68.

First pair of opposed fingers 12 and second pair of opposed fingers 14 are moveable and include an open position adapted to receive start lead 20 and finish lead 22 and a closed position that squeezably engages start lead 20 and finish lead 22, respectively. Fingers 12 and 14 open to allow leads 20 and 22 to be positioned between the opposed fingers. Once leads 20 and 22 are in position, the opposed fingers are moved to a closed position effective in squeezing leads 20 and 22 and thereby engaging them.

First pair of opposed fingers 12 and second pair of opposed fingers 14 are moveable and comprise proximal sections 66 and distal sections 68. Distal sections 68 include a configuration that minimizes the deformation of start lead 20 and finish lead 22 during manipulation of wound coil 18. This solves a large problem of prior art systems that suffered breakage of the leads during processing due to deformation caused by the fingers.

Figure 5:
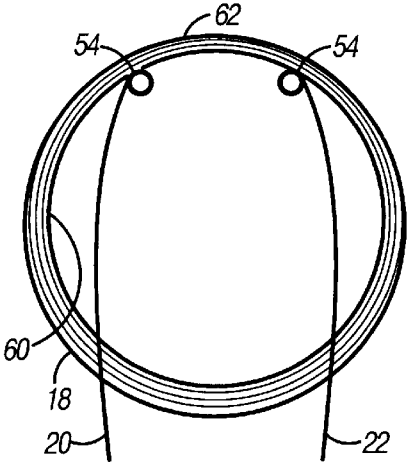
FIG. 5 is a top plan view of a wound coil subsequent to manipulation by the device for manipulating a wound coil in FIG. 1.
Figure 4:
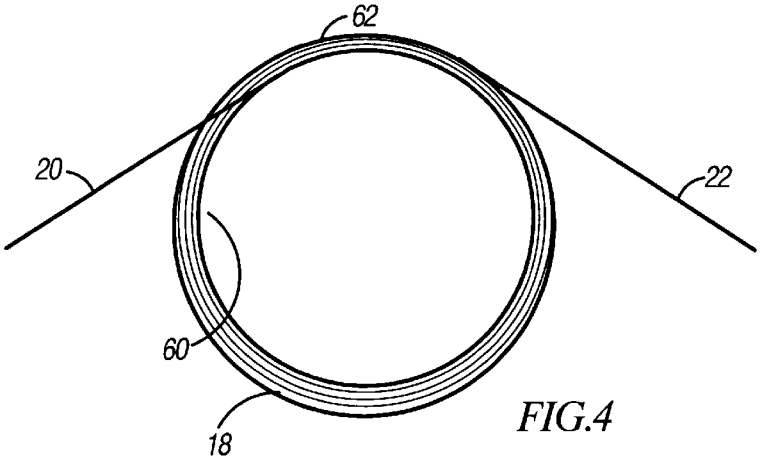
FIG. 4 is a top plan view of a wound coil prior to manipulation by the device for manipulating a wound coil in FIG. 1.

FIGS. 4 and 5 depict a wound coil before and after manipulation by device 10. FIG. 4 shows start lead 20 being tangential to inner circumference 60 of wound coil 18 and finish lead 22 is tangential to outer circumference 62 of wound coil 18. FIG. 5 shows leads 20 and 22 after being manipulated. Start lead 20 is located in a second position that is chordal to inner circumference 60 of wound coil 18 and finish lead 22 is located in a second position that is chordal to outer circumference 62 of wound coil 18.

Once start lead 20 and finish lead 22 have been moved to a second position, they are ready to be attached to a substrate or other suitable surface. This attachment can be accomplished by a laser, which severs leads 20 and 22 and attaches them to contacts on a substrate.

The present invention automates the handling and lead attach process of wound coil systems. A device for manipulating wound coils receives the wound coil from a spindle on coil winding equipment and secures both the wound coil body and the start and finish leads of the wound coil. The device positions the leads around tooling pins that act as pivot points. The coil and leads are then positioned on a substrate. The coil is usually placed into epoxy for adhesion to the substrate and the leads are positioned over conductive pads, or contacts, for attachment. Lead attachment can be achieved via soldering, conductive adhesive, or by welding. After the leads are terminated, the wound coil removal and placement device removes excess lead wire from the assembly and is capable of processing another wound coil. The device provides a quick, reliable way to receive wound coils, position the leads of the wound coil in a position effective to be attached to a substrate. This process has been made faster and more reliable by the present invention.

While this invention has been described in terms of certain examples thereof, it is not intended that it be limited to the above description, but rather only to the extent set forth in the claims that follow.

The embodiments of this invention in which an exclusive property or privilege is claimed are defined as follows:

What is claimed is:

1. A device for manipulating a wound coil, the wound coil including a start lead, a finish lead, a coil center, an inner circumference, and an outer circumference, the device comprising:

means for gripping the wound coil;

a first pair of opposed fingers for oppositely engaging the start lead of the wound coil;

a second pair of opposed fingers for oppositely engaging the finish lead of the wound coil;

means for moving the first pair of opposed fingers along an arc about an axis that is different from the coil center from a first position where the start lead is tangential to the inner circumference of the wound coil to a second position where the start lead is chordal to the inner circumference of the wound coil; and means for moving the second pair of opposed fingers along an arc about the axis from a first position where the finish lead is tangential to the outer circumference of the wound coil to a second position where the finish lead is chordal to the outer circumference of the wound coil.

2. A device for manipulating a wound coil in accordance with claim 1, wherein the means for gripping comprises an outwardly extending spindle finger configured to receive at least a portion of the wound coil.

3. A device for manipulating a wound coil in accordance with claim 1, wherein the means for gripping comprises an adjustable upper pair of spindle fingers and an adjustable lower pair of spindle fingers spaced a predetermined distance away from each other and configured to receive at least an upper portion and a lower portion of the wound coil, respectively.

4. A device for manipulating a wound coil in accordance with claim 1, wherein the means for gripping comprises an open position that is adapted to receive a portion of the wound coil and a closed position that is adapted to grip a portion of the wound coil.

5. A device for manipulating a wound coil in accordance with claim 1, wherein the means for gripping comprises an adjustable upper pair of spindle fingers and an adjustable lower pair of spindle fingers and substantially retractable forming pins adjacent and parallel to the upper pair of spindle fingers, the forming pins facilitating placement of the wound coil.

6. A device for manipulating a wound coil in accordance with claim 5, wherein the forming pins are in proximity to the inner circumference of the wound coil.

7. A device for manipulating a wound coil in accordance with claim 1, wherein the means for gripping comprises a pair of forming pins positioned in proximity to the inner circumference of the wound coil, the forming pins defining predetermined pivot points.

8. A device for manipulating a wound coil in accordance with claim 1, wherein the first and second pair of opposed fingers are moveable and comprise an open position adapted to receive the start and finish leads, respectively, and a closed position for squeezably engaging the start and finish leads, respectively.

9. A device for manipulating a wound coil in accordance with claim 1, wherein the first and second pair of opposed fingers are moveable and comprise proximal and distal sections, the distal sections including a predetermined configuration to minimize deformation of the start and finish leads during manipulation of the wound coil.

10. A device for manipulating a wound coil, the wound coil including a start lead, a finish lead, a coil center, an inner circumference, and an outer circumference, the device comprising:

a mechanism for gripping a portion of the wound coil, the mechanism comprising an adjustable upper and lower pair of spindle fingers spaced a predetermined distance away from each other and configured to receive at least an upper portion and a lower portion of the wound coil, respectively, the mechanism having an open position that is adapted to receive a portion of the wound coil and a closed position that is adapted to grip a portion of the wound coil;

a first pair of opposed fingers for oppositely engaging the start lead, the first pair of opposed fingers are moveable between an open position adapted to receive the start lead and a closed position for squeezably engaging the start lead;

a second pair of opposed fingers for oppositely engaging the finish lead, the second pair of opposed fingers are moveable between an open position adapted to receive the finish lead and a closed position for squeezably engaging the finish lead;

a mechanism for moving the first pair of opposed fingers along an arc about an axis that is different from the coil center from a first position where the start lead is tangential to the inner circumference of the wound coil to a second position where the start lead is chordal to the inner circumference of the wound coil; and a mechanism for moving the second pair of opposed fingers along an arc about the axis from a first position where the finish lead is tangential to the outer circumference of the wound coil to a second position where the finish lead is chordal to the outer circumference of the wound coil.

* * * * *